United States Patent [19]

Bokelman

[11] 4,343,317

[45] Aug. 10, 1982

[54] METHOD OF TREATING GREEN TOBACCO

[75] Inventor: Gordon H. Bokelman, Boulder, Colo.

[73] Assignee: Philip Morris Incorporated, New York, N.Y.

[21] Appl. No.: 214,492

[22] Filed: Dec. 9, 1980

[51] Int. Cl.[3] ..... A24B 3/00; A24B 3/18

[52] U.S. Cl. ..... 131/290; 131/297; 131/307; 131/356

[58] Field of Search ..... 131/290, 356, 370, 297, 131/298, 299–312

[56] References Cited

U.S. PATENT DOCUMENTS

| | | | |
|---|---|---|---|
| 940,181 | 11/1909 | Montag | 131/290 |
| 1,209,327 | 12/1916 | Oelenheinz | 131/290 |
| 3,845,774 | 11/1974 | Tso et al. | 131/370 |
| 4,018,234 | 4/1977 | Fiore | 131/309 |
| 4,131,118 | 12/1978 | Gellatly et al. | 131/356 |

*Primary Examiner*—V. Millin

*Attorney, Agent, or Firm*—Arthur I. Palmer, Jr.; George E. Inskeep

[57] ABSTRACT

A method is provided for treating uncured green tobacco whereby the chemical composition of the tobacco can be altered. The method involves expressing protoplasmic juice from green uncured tobacco by means of pressure and thereafter artificially curing the tobacco. The expressed juice may be collected and processed to alter its chemical composition. The processed juice may thereupon be reapplied to tobacco from which juice has been expressed to produce a tobacco product having desired chemical characteristics.

6 Claims, No Drawings

METHOD OF TREATING GREEN TOBACCO

BACKGROUND OF THE INVENTION (a) Field of the Invention

The present invention relates to a method of treating tobacco by expressing protoplasmic juices from green tobacco and thereafter artificially curing the tobacco, thereby altering the tobacco's chemical composition. Optionally the expressed juices may be processed and reapplied to the tobacco to further control the chemical composition of the tobacco.

(b) State of the Art

Alteration of the chemical composition of tobacco to thereby modify the smoking characteristics and/or combustion products of smoking tobacco products is known in the art. A common means to effect such alteration involves extraction of soluble constituents of cured tobacco, possibly followed by treatment of the tobacco extract to selectively remove constituents thereof and reapplication of the thus treated extract to a web of extracted tobacco.

Extraction of materials from green tobacco is also known in the art. For example, in U.S. Pat. No. 940,181 extract is pressed from green tobacco and applied to other tobacco to alter the qualities of the latter. U.S. Pat. No. 1,209,327 describes an improvement of the above process and further suggests removal of nicotine from the extract. In U.S. Pat. No. 4,018,234 freshly harvested tobacco is pressed by light non-abrasive contact with an absorbent surface to reduce its surface lipid content.

In U.S. Pat. No. 3,845,774 curing is effected by homogenizing yellowed tobacco leaf, incubating the homogenized material and then curing the mass as it is dried. The leaf characteristics may be manipulated during this homogenization curing method by chemical, physical or biological means.

It has now been discovered that by expressing protoplasmic juices from green tobacco, the chemical composition of the tobacco can be altered. Moreover, it has been discovered that tobacco from which the juices have been expressed can be artifically cured and can be further processed without the need for stemming or homogenization.

SUMMARY OF THE INVENTION

The present invention provides a process for modifying the chemical composition of tobacco without resorting to homogenization procedures. In accordance with the invention, juice is expressed from green uncured tobacco and the tobacco is then subjected to an artificial curing process. The expressed juice may be treated to selectively remove various constituents and may then be applied to tobacco from which juice has been expressed, either before or after the curing process.

DETAILED DESCRIPTION OF THE INVENTION

The present invention comprises a method for treating green tobacco to express the juices therefrom followed by artificial curing of the tobacco. The expressed juice may be processed to alter its chemical composition and may thereupon be applied to tobacco from which juices have been removed.

The process of the invention may be employed to treat fresh green tobacco. The tobacco may be treated in whole leaf form and thus the need to thresh the tobacco is avoided.

In accordance with the method of the invention green uncured tobacco is pressed to remove the protoplasmic juices. The manner in which the tobacco is pressed can vary depending on the end use of material. If the material is to be homogenized, more than one leaf layer can be pressed. If the material is to be used in the manner of leaf tobacco, then individual leaves should preferably be pressed. It is also possible for more than one leaf to be pressed thereby forming a continuous mat of fused/pressed leaves resembling a reconstituted tobacco sheet.

The pressing may be done between rollers at a pressure sufficient to flatten the stems, preferably under conditions which avoid shredding the leaves.

The press apparatus can be any device capable of supplying the required pressures. For example, an hydraulic, apple juice press or the like may be employed. Effecting the pressing while the tobacco is between pads or belts of fibrous material, such as felt, nylon or the like, facilitates the expression of juices while reducing shredding of the leaves. Since the juices can be removed without homogenization, there is no need to form reconstituted sheets from the tobacco, although homogenization may be employed if desired.

The pressures required to express the tobacco juices will depend upon the type and maturity of the tobacco leaves and the degree of extraction desired. The more mature leaves will require pressures above about 500 pounds per linear inch (pli) to flatten the stems and the veins of the leaves whereas somewhat lesser pressure will be required for the less mature leaves. Higher pressures also extract tobacco juices more efficiently. Normally, pressures between about 100 to 2,000 pounds per square inch (psi) or 500 to 1,200 pli have been found acceptable for flattening the leaves and expressing greater than about 40% of the tobacco fluids.

Following removal of the juices, the pressed tobacco may be dried and stored for a later treatment or it may be browned by artificially curing. For example, the tobacco may be thermally browned as, for example, by drying at ambient conditions and then heating to about 190° C. for about 15 minutes. Alternatively the tobacco may be photobleached, preferably following pretreatment with steam, a suitable alcohol or the like, and thereafter thermally browned. Artificial curing may also be effected by exposing the pressed tobacco to sulfur dioxide gas for a period of time sufficient to remove the green color and taste. Still another means of curing the pressed tobacco comprises soaking the tobacco in an acidic medium, preferably having a pH between 1.5 and 3.5 and incubating the soaked tobacco at temperatures above room temperature, preferably at about 50° C. until the tobacco loses its green color. After curing the tobacco is dried to the desired OV level.

Following such a curing step the tobacco has the form, color and handling characteristics of conventionally cured tobaccos. However, due to the pressing operation neither stemming nor homogenization is required prior to further processing, although the latter may be employed.

The expressed juices contain a number of tobacco constituents. As much as 75% of the total nitrogen and 94% of the total alkaloids in the tobacco can be removed in the expressed juices. These expressed juices can be collected and processed by selective treatment methods whereby their chemical composition is altered. For example, selective removal of soluble protein, potassium nitrate, phenols, chlorophyll, nicotine, starch and/or free amino acids might be effected according to conventional techniques. For example, by acidifying and/or by heating and centrifuging or ultrafiltering the juices, protein can be precipitated and removed. Ultrafiltration/fractionation may also be employed to remove other organic or inorganic substances. Fermentation to develop flavors or effect denitration or remove alkaloids, or deionization techniques may also be used.

By processing the expressed juices and thereupon reapplying them to or homogenizing them with tobacco, great flexibility in controlling the chemical composition of the tobacco is possible. Application of the treated juices to tobacco from which juices have been removed may be effected at any time. Such application may occur before or after curing.

The pressed leaves after recombination with the processed expressed juices can be fermented in order to develop unique subjective characteristics and the like. Further the expressed juices, either with or without processing, can be used as a medium for fermentation to produce tobacco flavor components.

In a preferred mode of operation, the tobacco is transported by conveyor to a roller press section. The leaves are pressed and then conveyed to a curing or drying section for further treatment. The expressed fluids are collected at the press section, processed and returned to the pressed tobacco.

The invention may be illustrated by the following examples.

EXAMPLE 1

A quantity of green bright Coker 411 tobacco leaves containing 80.8% OV were placed between felt pads and passed through a Noble and Woods press under 650 pounds per linear inch. The pressed leaves containing 50.8% OV represented 20.5% of the unpressed leaf weight and reflected a 75.5% reduction in total water content of the unpressed leaf. The pressed leaves were spread and air dried at ambient laboratory conditions for 2¼ hours resulting in pressed leaves having 13.1% OV. The still green dried leaves were then subjected to a heat treatment at 190° C. for 15 minutes in an oven to produce brown pressed leaves similar to cured tobacco.

The dark green juices which represented 79.5% of the unpressed leaf weight had a density of about 1.04 g/ml and a solids content of 8.4% after filtration.

Calculation of the proportional relationships of components of the leaves and the expressed juices based on 10.0 kg of starting material are as follows:

TABLE 1

| | Total Weight (Kg) | Water Content (Kg) | Water Content (%) | Solids Content (Kg) |
|---|---|---|---|---|
| Unpressed Leaves | 10.0 | 8.17 | 81.7* | 1.83 |
| Green Pressed Leaves | 2.05 | 1.04 | 50.8 | 1.01 |
| Expressed Juices | 7.95 | 7.13 | 89.7 | 0.82 |
| Dried Pressed Leaves | 1.137 | 0.127 | 11.2 | 1.01 |

*Reflects derived water content; measured content 81.2%

Analytical results for the materials are set forth in Table 2.

TABLE 2

| | Green Leaf | Pressed Leaf | Filtered Expressed Juice | Other |
|---|---|---|---|---|
| Water | 100.1% | 1.6% | 87.3% | 11.2% (Water Vapor) |
| Total Solids | 100% | 55.2% | 44.8% | — |
| Total Nitrogen (As Is) | 0.0040 (100%) | 0.000989 (24.7%) | 0.00151 (37.8%) | 0.0015 (37.5%)# |
| Total Nitrogen (DWB)* | 0.0213 (100.1%) (2.13%) | 0.0054 (25.4%) (0.98%) | 0.0082 (38.5%) (1.84%) | 0.0077 (36.2%)# |
| Total Alkaloids (As Is) | 0.0030 (100%) | 0.00017 (5.7%) | Insufficient Data | Insufficient Data |
| Total Alkaloids (DWB)* | 0.0159 (100%) (1.59%) | 0.00094 (5.9%) (0.17%) | Insufficient Data Insufficient Data | Insufficient Data Insufficient Data |

*Dry weight basis

#A portion of this material is probably retained within the felt pad during pressing (i.e. selective absorption) and another portion is probably removed during filtration of the expressed juice.

The analytical results show a reduction in nitrogen for the pressed leaf of 75% and a reduction of alkaloids of 94%. This last result would be valuable in development of a low nicotine smoking product.

EXAMPLE 2

Juices were expressed by placing leaf samples from overmature green bright tobacco and from mature green burley tobacco on a Carver hydraulic press at 2000 psi. The fluids were heated for 25 minutes at 57° C., cooled and centrifuged to remove the precipitated protein. From measurement of soluble protein in the liquids by the Coomassie-Blue dye-binding procedure it was determined that 42% of the protein was removed from each batch by this treatment. This method of treating the expressed juices provides a simple means by which the nitrogen content may be reduced before the juice is recombined with the leaf, as well as a means by which a potentially useful byproduct may be recovered.

EXAMPLE 3

Coker 319 bright tobacco, mature upper stalk, harvested one week earlier and stored at −20° C., was treated in three forms: unpressed, pressed, and pressed and dried. The pressed tobacco was obtained by twice passing the tobacco leaves between felt pads through a Noble and Wood Press at 650 pounds per linear inch. A sample of the pressed tobacco was dried at ambient conditions for 24 hours to yield tobacco having 13% OV.

Aqueous acids were adjusted to pH 3.5 as follows: 20 ml of distilled water plus one drop of glacial acetic acid; 80 ml of water plus one drop of concentrated phosphoric acid; 30 ml of distilled water plus one drop of formic acid. Leaf sections measuring 3/8 by 3/8 inch were immersed in the solutions in stoppered vials and held at ambient temperature in a dark place. Observations after 3 and 5 days are tabulated in Table 3.

TABLE 3

| Mature Green Bright Leaf - Room Temperature Incubation | | | |
|---|---|---|---|
| | | Appearance | |
| Liquid | Sample | 3 Days | 5 Days |
| Distilled Water | Unpressed | yellowish green | greenish yellow |
| | Pressed | light green | yellowish green |
| | Pressed, dried | light green | yellowish green |
| Acetic Acid | Unpressed | very light greenish yellow | brownish yellow |
| | Pressed | slight greenish yellow | brownish yellow |
| | Pressed, dried | light greenish yellow | slight greenish yellow |
| Phosphoric Acid | Unpressed | yellow | yellow |
| | Pressed | slight greenish yellow | slight greenish yellow |
| | Pressed, dried | slight greenish yellow | slight greenish yellow |
| Formic Acid | Unpressed | brownish yellow | brownish yellow |
| | Pressed | slight greenish yellow | slight greenish/brown yellow |
| | Pressed, dried | light greenish yellow | greenish yellow |

EXAMPLE 4

Burley leaf, Ky 14, mature but not yellow, harvested three days earlier and stored at −20° C., was cut into $\frac{3}{8}\times\frac{3}{8}$ inch sections. Pressed samples were produced as described in Example 3. Samples were immersed in 20 ml of the treating solutions as indicated in Table 4 in vials. The vials were then heated to 50° C. and sealed, wrapped in aluminum foil, and maintained at that temperature. Observations at the specified intervals are recorded in Table 4.

TABLE 4

| Mature Burley Green Leaf - Incubation at 50° C. | | | | |
|---|---|---|---|---|
| Treating | | Appearance | | |
| Solution | Sample | 1 Day | 2½ Days | 4 Days |
| 2 drops 2-chloroethyl-phosphonic acid | Pressed | slight brownish yellow | light brownish yellow | very light yellow brown |
| | Unpressed | brownish yellow | brownish yellow | yellowish brown |
| Acetic acid, pH 3.5 | Pressed | slight brownish yellow | light brownish yellow | very light yellow brown |
| | Unpressed | brownish yellow | brownish yellow | yellowish brown |
| | Pressed, dried | slight brownish yellow | light yellowish brown | — |
| Distilled Water | Pressed | light green | light brownish yellow-green | pale greenish yellow |
| | Unpressed | brownish yellow | brownish yellow-green | light greenish brown |
| | Pressed, dried | light greenish yellow | light greenish brown | — |
| 4 Drops lactic acid | Pressed | slight brownish yellow | light brownish yellow | very light yellow brown |
| | Unpressed | brownish yellow | brownish yellow | yellowish brown |
| Sodium chloride, 5% (brine) | Pressed | green | light greenish yellow | light greenish yellow |
| | Unpressed | brownish green | greenish brown | greenish brown |

EXAMPLE 5

Small samples of mature green bright tobacco, Coker 319, stored in a cool room for two weeks after harvesting, were placed in vials as in Example 3 and covered with water adjusted to a range of pH levels as follows: for pH less than 7, addition of phosphoric acid; for pH greater than 7, addition of concentrated aqueous KOH; and for pH 7.0, addition of potassium phosphate (monobasic)/sodium hydroxide as buffer. The vials were stoppered and wrapped in foil, placed in constant temperature bath at 50° C., and opened at intervals for observation. Table 5 gives the color changes noted in the leaf sections.

TABLE 5

Mature Green Bright Leaf - Incubation at 50° C.
Color Code: 1. green; 2. light green; 3. yellowish green; 4. greenish yellow; 5. yellow; 5.5 light brownish yellow; 6. brownish yellow; 7. yellowish brown; 8. light brown; 8.5 brownish green; 9. light greenish brown; 10. greenish brown; 11. brown.

| | | | Color Rating | | | | |
|---|---|---|---|---|---|---|---|
| | Treatment | | 4½ hours | 1 Day | 2 Days | 3 Days | 4 Days |
| Un- | pH | 1.5 | 5 | 5 | 5 | 5 | 5 |
| | | 2.5 | 2 | 6 | 6 | 8 | 8 |
| | | 3.5 | 1 | 4 | 4 | 6 | 7 |
| | | 4.5 | 1 | 4 | 4 | 6 | 7 |
| | | 5.5 | 1 | 4 | 4 | 6 | 6 |
| | | 7.0 | 1 | 3 | 3 | 6 | 7 |
| | | 8.5 | 1 | 3 | 4 | 6 | 6 |
| | | 9.5 | 1 | 3 | 4 | 6 | 6 |
| | | 10.5 | 1 | 3 | 4 | 6 | 6 |
| | | 11.5 | 1 | 1 | 2* | 2 | 2 |
| | | 12.5 | 1 | 1 | 2* | 1 | 1 |
| | Tap | $H_2O$ | 1 | 3 | 9 | 9 | 9 |
| Pressed | pH | 1.5 | 6 | 7 | 7 | 11 | 11 |
| | | 2.5 | 3 | 7 | 11 | 9 | 8 |
| | | 3.5 | 1 | 4 | 8.5 | 9 | 8 |
| | | 4.5 | 1 | 3 | 8.5 | 9 | 8 |
| | | 5.5 | 1 | 3 | 8.5 | 9 | 8 |
| | | 7.0 | 1 | 2 | 2 | 2 | 9 |
| | | 8.5 | 1 | 2 | 3 | 3 | 9 |
| | | 9.5 | 1 | 2 | 8.5 | 3.5 | 8 |
| | | 10.5 | 1 | 2 | 3 | 3 | 9 |
| | | 11.5 | 1 | 1 | 1* | 2 | 2 |
| | | 12.5 | 1 | 1 | 1* | 1 | 1 |
| | Tap | $H_2O$ | 1 | 1 | 1 | 8.5 | 8.5 |

*Solution had light green color.

As the greenish tinges are least desirable, the results indicate that acceptable coloration (codes 5 through 8 or 11) is rapidly achieved at very low pH, 1.5 to 2.5. Longer exposures may produce similar results at higher pHs.

EXAMPLE 6

Sections of Coker 411 bright tobacco green leaf, about 3" by 1", both as-picked and pressed to expel liquids, were suspended by tape from the mouths of pint jars. The sections were hanging free in the jars. Gaseous $SO_2$ was introduced into the bottom of the jars in a hood for 15 seconds and the jars were then quickly capped. The unpressed leaf turned completely golden brown in 15 minutes, the pressed leaf turned this color in 45 minutes. When left exposed to the outside atmosphere for several days, the sections retained a desirable color.

EXAMPLE 7

A sample of green tobacco, Coker 319 bright, from the upper stalk position in the 16th week of plant growth, was harvested and pressed between felt belts on a roller press at about 780 pli (pounds per linear inch) and allowed to dry in a forced air oven at 40° C. The sample was then divided equally, 12 g each, to produce Samples A and B. Sample A was kept as the control.

Sample B was placed in a one-gallon glass jar and exposed to $SO_2$ gas for 25 seconds with the $SO_2$ cylinder valve wide open for maximum $SO_2$ delivery. At the end of this exposure of the pressed/dried tobacco to $SO_2$, the glass jar was sealed and put into the hood overnight. The next day parts of the $SO_2$-treated tobacco had achieved a light brown color but for the most part the treated tobacco was still green and similar to the Sample A control.

The treated tobacco was then humidified with steam (a few seconds) followed with an additional $SO_2$ treatment for 25 seconds, and allowed to stand in the resealed glass jar. This time the treated tobacco turned to a uniform yellow color almost immediately. The yellowed Sample B was then taken out of the jar and allowed to air dry for about 65 hours.

These results indicate that the $SO_2$ browning of green tobacco is achieved faster in the presence of moisture.

EXAMPLE 8

Two inch square sections of greenhouse grown Coker 298 mature green leaf tobacco were placed in a plastic bag. Two inch square sections of the same type of tobacco were pressed in a Carver hydraulic press at 3000 psi and were also placed in the plastic bag.

The sections were steamed for 3 minutes and then placed under a fluorescent desk lamp for 6 hours. The sections were rewet and bleached a further 8 hours. Some slight browning occurred. Considerable photobleaching was observed in both the pressed and unpressed sections, with the pressed sections being especially bleached.

Pressed and unpressed sections of the photobleached tobacco were placed in an oven at 190° C. for 7 minutes. A brown color appeared.

EXAMPLE 9

Mature green, unpressed (low stalk) leaf section of Coker 411, greenhouse grown tobacco were placed in a plastic bag along with 2 sections of the same tobacco pressed at 3000 psi on a Carver hydraulic press. Approximately 1 ml of octyl alcohol was placed in an upright eyeglass in the center of the bag which was lying flat with 2 leaf sections on either side of the glass. An aluminum sheet was placed under the plastic bag to give optimum reflection of light. A 150 watt flood light giving approximately 3000 ft candles (33,000 lux) of incandescent light was placed approximately 20" above the leaf sections. This light was selected to maintain the surface temperature below 38° C. The light was measured by a "Lunar Pro" light meter.

In 2 hours the pressed sections exhibited some bleaching. Considerable moisture condensation occurred over the unpressed section of the bag. After 6 hours only a little green color remained. Upon continued bleaching for about 8 hours, the pressed section became completely white while the unpressed section became yellowih brown. The alcohol did not evaporate, but rather most remained in the eyeglass. Bleaching was continued for several days to observe the long range effects of photobleaching; nothing further happened.

The final pressed result was bleaching to almost transparent while the unpressed section was golden brown except for a few green spots.

After about 24 hours of light most of the photobleaching had taken place when the tobacco was incubated with octyl alcohol. Some period, possibly a period of 14–15 hours, of preincubation with the octyl alcohol might hasten the reaction as reported by Sisler, Tobacco Science XX: 32–36, 1977.

EXAMPLE 10

Pressed and unpressed tobacco materials as in Example 9 were sealed in a plastic bag for pre-incubation in the presence of acetone before photobleaching was begun. The light as in Example 9 was turned on after 18 hours of pre-incubation at which time the acetone had not completely evaporated. The temperature was maintained below 38° C. At the end of 6 hours the unpressed section was beginning to become brownish white and there was a slight bleaching of the pressed section. After 6–7 hours the acetone had evaporated from the glass plate and recondensed on the plastic bag.

The unpressed section was creamy white with some slight brownish areas the next day; the pressed section was bleached to a light green color. The following day the control section was very white with a tendency to brown in certain areas; the pressed section was bleached almost transparent with a slight green tinge.

After 24 hours the control section bleached completely white. Nearly 40 hours were necessary to photobleach the pressed section. The photobleaching may progress more rapidly when a uniform moisture level is maintained in the sections during the bleaching.

EXAMPLE 11

Pressed and unpressed control leaf sections of tobacco as described in Example 9 were suspended in pint jars by paper clips and allowed to hang free during a 3 minute steam treatment. The sections of untreated and steam treated were placed in a plastic bag and sealed shut to prevent excessively rapid drying. The plastic bag was then placed under the flood lamp as in Example 9 to photobleach.

After about 16 hours of photobleaching the steam treated sections were completely bleached white. The untreated pressed section was about ½ bleached transparent, while the untreated unpressed section was somewhat yellowed but still mostly green.

After about 30 hours of photobleaching the pressed section of the untreated tobacco had bleached nearly transparent. There was little further change in the unpressed section of untreated tobacco. Further attempts to bleach the untreated unpressed section of tobacco had little effect except the green color nearly disappeared as normal yellowing developed.

EXAMPLE 12

Using Coker 411 greenhouse grown, low stalk mature green leaf, both pressed and unpressed, was exposed to UV light. A pressed and unpressed leaf section was suspended into the mid area of an ultraviolet cabinet between four, 15 watt GE 1528 bulbs in the short UV range (2200–3000A°) with a peak at 2600A°, 260 nm. This compares with 400–800 nm for visible light. The light intensity was not measured. The experiment was run for 3 hours with nothing visible happening. The temperature was monitored and never got above 32° C. The tobacco did not bleach.

Using the same green tobacco source as above, steamed pressed and unpressed leaf sections were exposed to UV light as described above except a plastic bag was placed over the sample. After 3 hours there was some light photobleaching. After an additional 16 hours the leaf material did bleach. There was some difficulty with folding of the leaf and also with excessive drying of the material. The final color was off-white with the folded areas of the leaf maintaining some green color. The temperature was maintained at 32° C.

The UV photobleaching was found a bit cumbersome due to the requirement that the samples be suspended between the lights, and also there was difficulty in preventing the sample from drying out.

What is claimed is:

1. A method for treating whole green tobacco leaf comprising:

(a) expressing protoplasmic juice from the tobacco leaf by means of pressure; and (b) artificially curing the tobacco leaf product resulting from step (a).

2. The method of claim 1 further comprising:

(a) collecting the expressed juice by healing, acidifying or deionizing;

(b) processing the juice to selectively remove at least one constituent thereof; and (c) applying the processed juice to tobacco from which juice has been removed.

3. The method of claim 2 wherein the processed juice is applied to the tobacco prior to curing.

4. The method of claim 2 wherein the processed juice is applied to the tobacco after curing.

5. The method of claim 1 wherein the juice is expressed by passing the tobacco leaf betwen rollers under pressure, there being a layer of fibrous material between the said tobacco leaf and the said rollers.

6. The method of claim 5 wherein the pressure is sufficient to flatten the stems of the tobacco.

* * * * *

UNITED STATES PATENT AND TRADEMARK OFFICE

CERTIFICATE OF CORRECTION

PATENT NO. : 4,343,317

DATED : August 10, 1982

INVENTOR(S) : Gordon H. Bokelman

It is certified that error appears in the above-identified patent and that said Letters Patent is hereby corrected as shown below:

Correct Claim 2 as follows:

2. The method of claim 1 further comprising:

(a) collecting the expressed juice [by healing, acidifying, or deionizing] ;

(b) processing the juice by heating, acidifying or deionizing to selectively remove at least one constituent thereof; and (c) applying the processed juice to tobacco from which juice has been removed.

Signed and Sealed this

*Twenty-sixth* Day of *February 1985*

[SEAL]

*Attest:*

DONALD J. QUIGG

*Attesting Officer*

*Acting Commissioner of Patents and Trademarks*